United States Patent [19]

Gallego

[11] Patent Number: 4,850,626

[45] Date of Patent: Jul. 25, 1989

[54] IMPROVED LATCH BOLT WITH SELECTIVELY VARIABLE DRIVING PIN DEPTH

[75] Inventor: Luis V. Gallego, Fuenterrabia, Spain

[73] Assignee: Talleres de Escoriaza, S.A., Spain

[21] Appl. No.: 166,736

[22] Filed: Mar. 2, 1988

Related U.S. Application Data

[63] Continuation of Ser. No. 891,473, Jul. 29, 1986, abandoned.

[30] Foreign Application Priority Data

Jul. 31, 1985 [ES] Spain ..... 545765

[51] Int. Cl.[4] ..... E05C 1/16

[52] U.S. Cl. ..... 292/337; 292/DIG. 60; 292/1

[58] Field of Search ..... 292/337, DIG. 60, 169.13, 292/169.15, 169.21, 169.23, 169.22, 1

[56] References Cited

U.S. PATENT DOCUMENTS

| | | | |
|---|---|---|---|
| 2,776,155 | 1/1957 | Gerlach | 292/337 X |
| 2,795,447 | 6/1957 | Schlage | 292/337 X |
| 3,300,240 | 1/1967 | Tornoe et al. | 292/337 |
| 3,441,269 | 4/1969 | Doyle | 292/337 X |
| 3,790,196 | 2/1974 | Sanders et al. | 292/337 X |
| 4,427,224 | 1/1984 | Bergen | 292/169.23 |
| 4,468,059 | 8/1984 | Nelson et al. | 292/DIG. 60 |
| 4,516,798 | 5/1985 | Bergen | 292/169.23 |
| 4,593,542 | 6/1986 | Rotondi et al. | 292/337 |
| 4,615,549 | 10/1986 | Couture | 292/337 X |
| 4,623,174 | 11/1986 | Trull et al. | 292/337 X |
| 4,639,025 | 5/1988 | Fang | 292/337 |
| 4,687,239 | 8/1987 | Lin | 292/337 |
| 4,711,477 | 12/1987 | Fann et al. | 292/337 |
| 4,767,140 | 8/1988 | Lin | 292/337 |

*Primary Examiner*—Richard E. Moore
*Assistant Examiner*—Eric Nicholson
*Attorney, Agent, or Firm*—Lucas & Just

[57] ABSTRACT

An improved latch bolt is disclosed that has a single sliding tail with two pairs of prominences permanently fixed to the tail such that the latch bolt has variable driving pin depths.

8 Claims, 4 Drawing Sheets

15
19
18
14
17
20
21

16
22
17
14
23
24

1
5
8
7
3
11
2
4
9
10
6

12
13

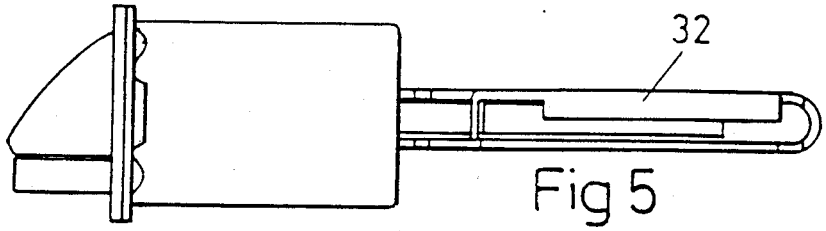
Fig 5
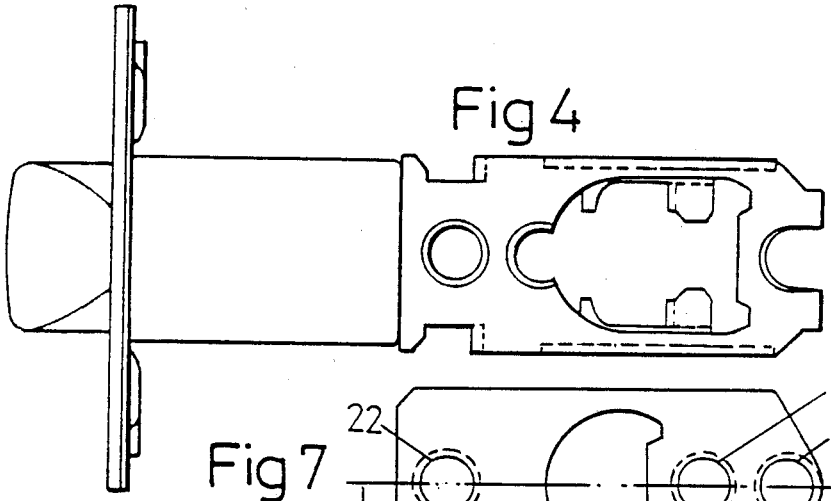
Fig 4
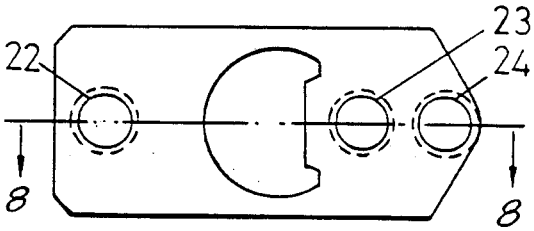
Fig 7
Fig 6
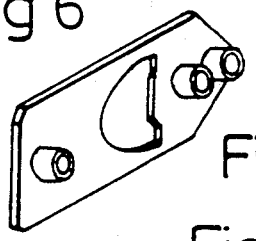
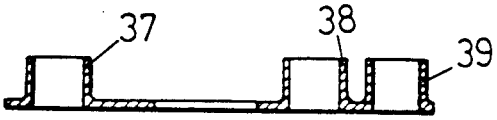
Fig 8
Fig 10
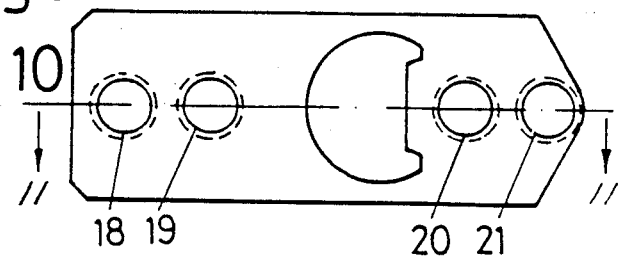
Fig 9
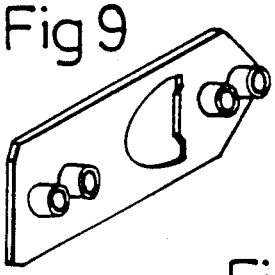
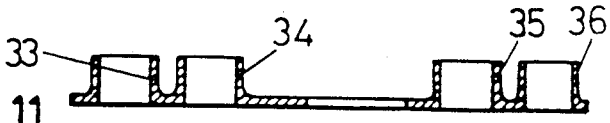
Fig 11

Fig 17
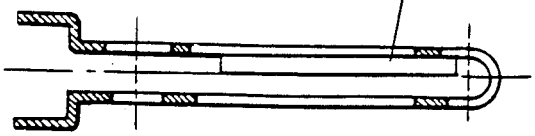
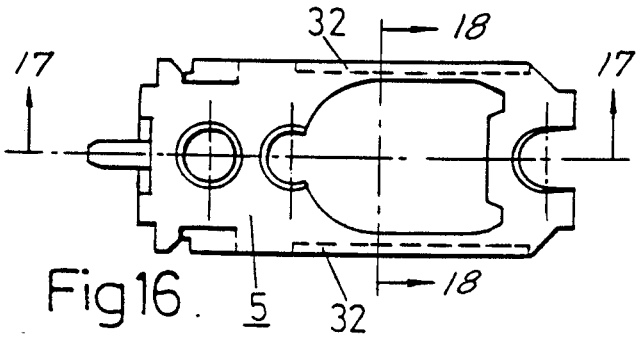
Fig 16.
Fig 18
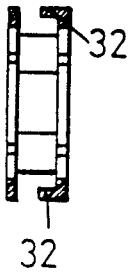
Fig 20
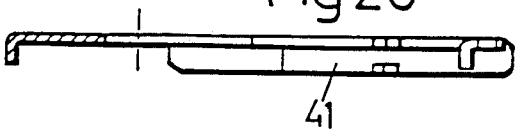
Fig 21
Fig 22
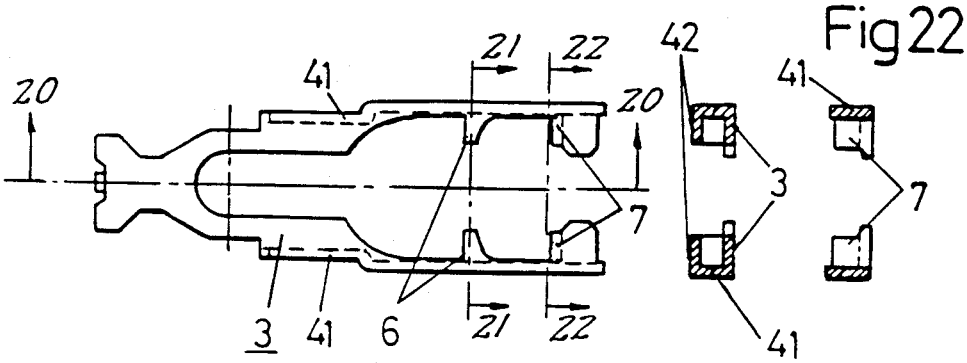
Fig 19

IMPROVED LATCH BOLT WITH SELECTIVELY VARIABLE DRIVING PIN DEPTH

This is a continuation of application Ser. No. 891,473, filed July 29, 1986, now abandoned.

SCOPE OF THE INVENTION

This is an invention relating to the latch bolts that are normally used for locking doors and are moved by a knob and handle drive member of known type, the driving pin of which is situated in a transverse position with respect to the bolt.

In our description we shall call the distance existing between the front of the bolt and the pin of the transverse drive member the "driving pin depth"; this dimension coincides with the distance between the edge of the door and the pin of the drive member, since the front of the bolt is set flush with the edge of the door jamb.

The principal problem existing in the latch bolts normally used is that each manufacturer has been making them with a different driving pin depth and when a substitution has to be made, it was necessary to obtain a latch of exactly the same depth.

In the industry, with the application of rules of standardization, this defect has been solved, but only partially, and pin depth measurements have been unified, though not in a single measurements, but in two, so that at present the standardized measurements of driving pin depth are sixty and seventy millimeters.

We therefore find that, even with standardized measurements, if the user wishes to substitute a door bolt, he has to buy another of the right measurement, which is a problem unless he is an expert, and because of the coexistense of two standardized measurements, manufacturers, warehouses and retail outlets are forced to duplicate stocks of all models in order to meet the demand for two different standardized measurements.

All these problems would be solved with a bolt capable of being adapted to different driving pin depths, but this problem has not yet been satisfactorily resolved.

No attempt that has been made to obtain a bolt adaptable as to pin depth, through the substitution of internal parts of the mechanism, can be considered satisfactory, because this is a complicated and expensive product and, furthermore, the handling of internal parts in order to make a change of dimension is complicated for a consumer who is not usually expert in these mechanisms.

OBJECT AND SUMMARY OF THE INVENTION

The object of our invention is a simple latch bolt whose driving pin depth is selectively variable in order to adopt the two standardized measurements with the same member.

For that purpose, the sliding tail of the latch has two pairs of prominences formed, those of each pair facing each other and each of the pairs situated at a different distance from the front of the bolt and in turn the guide casing, which secures the tail with its side edges, has a wide transverse window opened up on both faces that encompasses the two pairs of prominences and also possesses three transverse real holes with centers aligned with its center line, the assembly being completed by two optional flat affixable pieces, which possess holes that are bushed or extended crosswise with bushings, with the location of their axes coinciding with the holes of the casing, and a circular cavity optionally situated coinciding longitudinally with the operating area of one of the two pairs of prominences of the sliding tail, all so that by choosing either of the two optional affixable pieces and affixing it with insertion of its bushings in the holes of the casing, we selectively vary the driving pin depth or distance existing between the front of the latch and the pin of the transverse drive member usually employed.

It will therefore be sufficient to choose one of the two optional pieces and to mount it in order to have the bolt of the right measurement; the choice of the correct piece is evident by simple dimensional comparison with the old bolt.

The mounting of the piece is also evident and it can only be inserted on the correct side.

Both operations (choise and mounting) are therefore within reach of the least expert user, and with a single bolt of simple manufacture, we have solved all of the currently existing problems.

To understand the nature of the invention better, we represent on the attached drawings (merely by way of illustrative and nonlimitative example) one preferred industrial embodiment, to which we refer in our description on said drawings.

DESCRIPTION OF THE DRAWINGS

FIG. 4 is a view in elevation of the bolt.

FIG. 5 is a bottom plan view of the bolt, with respect to the previous figure.

FIG. 6 is a perspective of one of the affixable pieces.

FIG. 7 is a view in elevation of the piece of FIG. 6.

FIG. 8 is a section seen along line 8—8 of FIG. 7.

FIG. 9 is a perspective of the other affixable piece.

FIG. 10 is a view in elevation of the piece of FIG. 9.

FIG. 11 is a section seen along line 11—11 of FIG. 10.

FIG. 16 is a view in elevation of the guide casing of the tail of the latch.

FIG. 17 is a section seen along line 17—17 of FIG. 16.

FIG. 18 is a section seen along line 18—18 of FIG. 16.

FIG. 19 is a view in elevation of the sliding tail of the latch.

FIG. 20 is a section seen along line 20—20 of FIG. 19.

FIG. 21 is a section seen along line 21—21 of FIG. 19.

FIG. 22 is a section seen along line 22—22 of FIG. 19.

Figures 1, 2, 3:
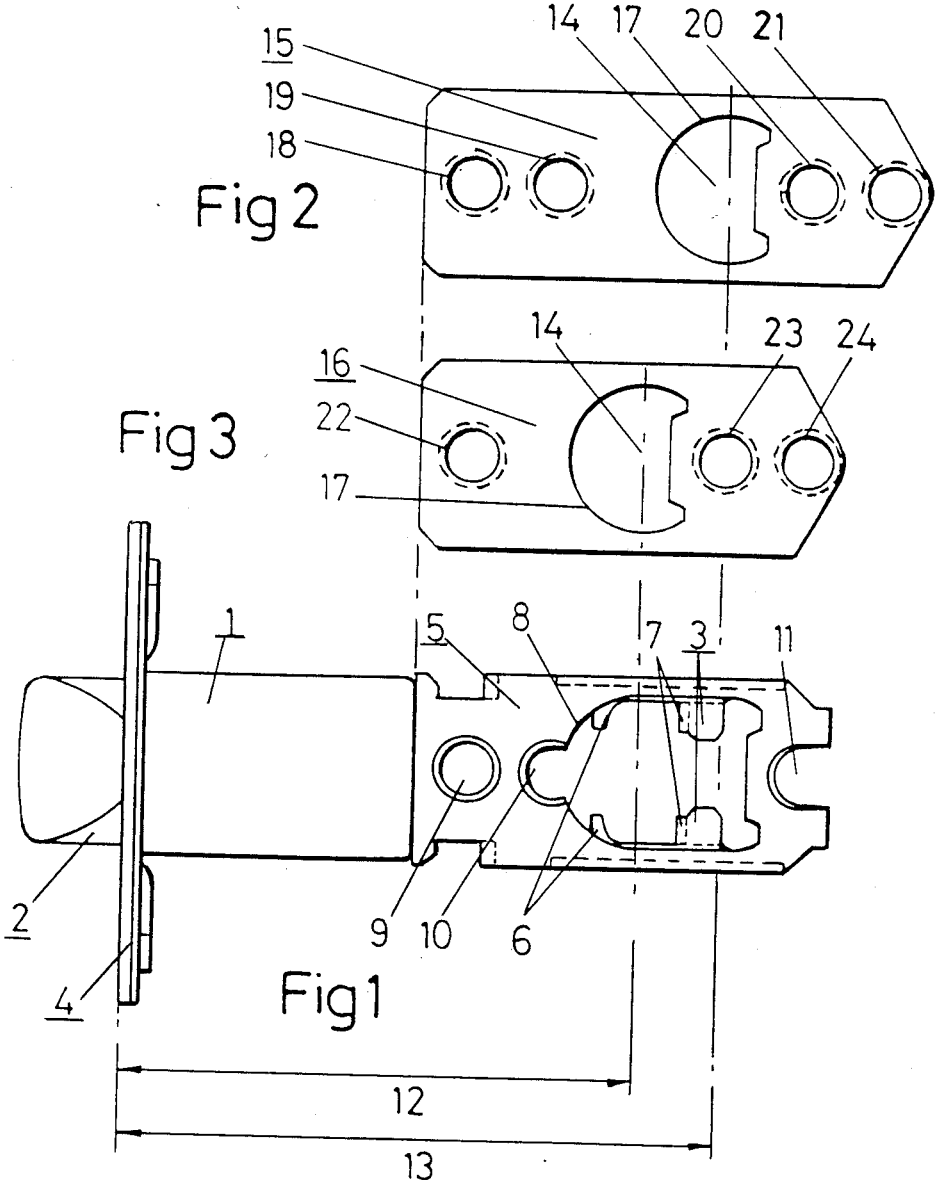
FIG. 1 is a view in elevation of the bolt without the affixable pieces.
FIG. 2 is a view in elevation of one of the affixable pieces.
FIG. 3 is a view in elevation of the other affixable piece.

On these figures the following features are indicated:

1. Bolt body
2. Bolt head
3. Latch sliding tail
4. Front of bolt
5. Guide casing of the tail (3)
6. Front pair of facing prominences
7. Back pair of facing prominences
8. Transverse window of the casing (5)
9. First real hole of the casing (5)
10. Second real hole of the casing (5)
11. Third real hole of the casing (5)

12. First depth of pin of the latch drive member
13. Second depth of pin of the latch drive member
14. Pin of the latch drive member
15. Optional affixable piece
16. Optional affixable piece
17. Circular cavity
18. Bushed hole of piece (15)
19. Bushed hole of piece (15)
20. Bushed hole of piece (15)
21. Bushed hole of piece (15)
22. Bushed hole of piece (16)
23. Bushed hole of piece (16)
24. Bushed hole of piece (16)
25. Indication of section
26. Indication of section
27. Indication of section
28. Indication of section
29. Indication of section
30. Indication of section
31. Indication of section
32. Bent side edges of casing (5)
33. Bushing of hole 18
34. Bushing of hole 19
35. Bushing of hole 20
36. Bushing of hole 21
37. Bushing of hole 22
38. Bushing of hole 23
39. Bushing of hole 24
40. Ends of stop of the cavity (17)
41. Flanges of the tail (3)
42. New bend of the flange (41)

DESCRIPTION OF THE EMBODIMENT CONTEMPLATED

The different pieces have been represented on the drawings, occupying a relative position horizontally that corresponds to their mounting position, in order to contribute thereby to a better understanding.

The latch members to which no reference is made in our description are of known type and in any case do not form part of the invention.

The basic elements of the invention are shown on FIGS. 1, 2 and 3.

The body (1) of the bolt houses the conventional internal security mechanisms of the latch head (2) emerging with respect to the front (4), which is made flush with the edge of the door jamb.

Joined to the latch head (2) is the sliding tail (3) whereby it receives the drive of the conventional transverse drive member, which has not been represented.

The sliding tail (3) represented in detail on FIGS. 19, 20, 21 and 22 is guided in its displacement by the guide casing (5), which is joined to the body (1) and is represented in detailed on FIGS. 16, 17 and 18.

In accordance with the invention, the sliding tail (3) has two pairs of prominences (6 and 7) formed, the two prominences that comprise each pair facing each other and each of the pairs (6 and 7) situated at a different distance from the front (4) of the bolt.

The guide casing (5) secures the tail (3) with its side edges (32); see in detail on FIGS. 5, 16, 17 and 18.

The guide casing (5) has a wide transverse window (8) opened up on both faces, which embraces the two pairs of prominences (6 and 7). The casing (5) also has three transverse real holes (9, 10 and 11) with their centers aligned on the longitudinal center line of the bolt.

The assembly is completed with two optional flat affixable pieces (15 and 16) that have holes (18, 19, 20, 21, 22, 23 and 24) extended crosswise with bushings (see FIGS. 6, 8, 9, and 11). The axes of these holes (18, 20, 21, 22, 23, and 24) coincide with the holes of the casing (5).

The affixable pieces (15 and 16) also have a circular cavity (17) optionally situated coinciding longitudinally with the operating area of one of the two pairs (6 and 7) of facing prominences, so that the cavity (17) of affixable piece (16) corresponds to the operating area of pair of prominences (6) and the cavity (17) of affixable piece (15) corresponds to the operating area of pair of prominences (7).

Figure 13:
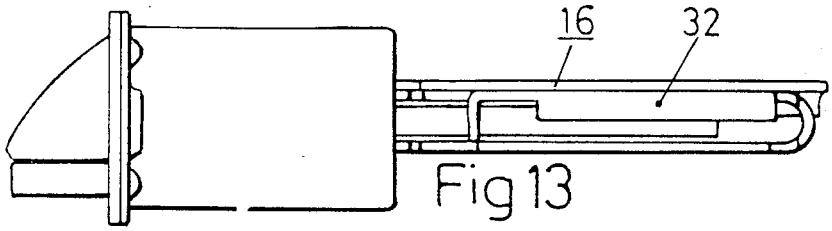
FIGS. 12 and 13 are respectively a view in elevation and vertical plan view from the bottom of the bolt with the affixable piece of FIG. 6 already inserted.
Figure 12:
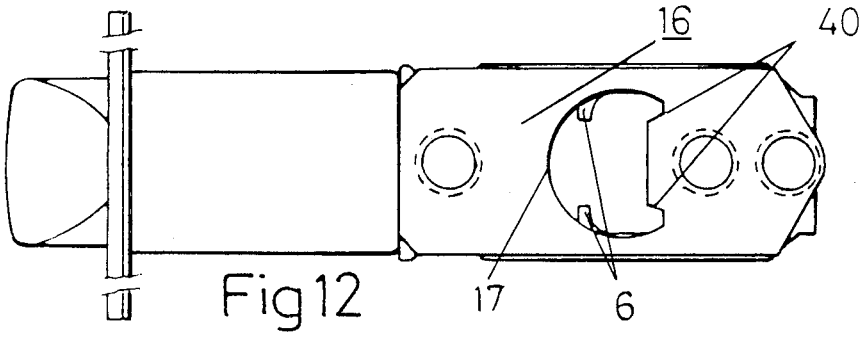
Figure 14:
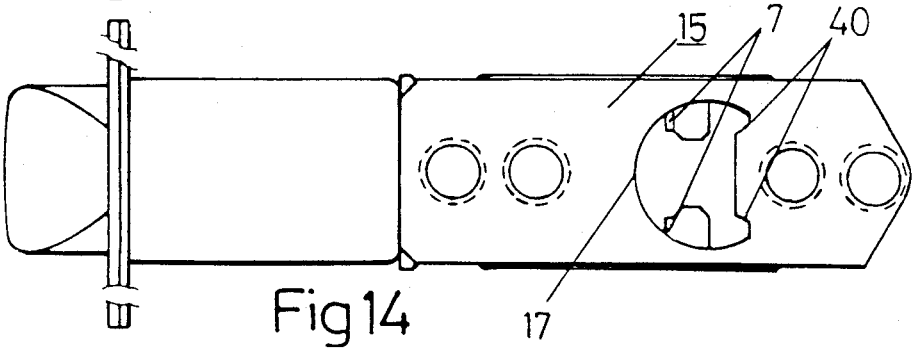

The driving pin depth (12 and 13) or distance existing between the front of the latch (4) and the pin of the transverse drive member usually employed is represented on FIG. 1 and the depth (12) corresponds to the standardized measurement of sixty millimeters and to piece (16); depth (13) corresponds to the measurement of seventy millimeters and to piece (15). In order to vary this depth selectively, it will be sufficient to choose either of the two optional affixable pieces (15 and 16) and to affix it with the insertion of its bushings (33 to 36, or 37 to 39) in the holes (9 to 11) of the casing (5) in order to obtain an effective bolt for both standarized measurements. The assembly mounted with affixable piece (16) is shown on FIGS. 12 and 13 and the assembly mounted with affixable piece (15) is shown on FIGS. 14 and 15.

On the affixable pieces (15 and 16) the circular cavity (17) has an angular amplitude that coincides with the operating path of the transverse drive member used, the ends (40, FIGS. 12 and 14) of the sector (17) constituting stops that limit the operating path of the drive member, avoiding undesirable stresses on the sliding tail (3) of the latch.

The distribution of hollow spaces and holes existing in the sliding tail (3) as well as in the casing (5) has been the subject of painstaking study for correct operation on both measurements, without the moving members interfering with each other on their displacement in any of these cases.

For that purpose, the casing (5), in relation to the front (4) of the bolt, has the following holes: a first complete circular real hole (9); a second real hole (10) of proper circular section exceeding one hundred eighty degrees and the rest intersecting with the transverse window (8) and a third real hole (11) of proper circular section exceeding one hundred eighty degrees and the rest open toward the back edge of the casing (5).

Each of the holes (9, 10, 11) existing in the casing (5) is characterized in that those facing on both faces of the casing (5) have different sections, so that both permit passage of the means of fastening of the drive member, which must pass the bolt, but only the holes (9, 10 and 11) of one of the faces of the casing (5) have sufficient amplitude to permit accommodation of the section of bushings (18 to 21, or 22 to 24) of the affixable pieces (15 and 16); this assures us that the pieces (15 and 16) will necessarily be affixed on the right face, which is the one corresponding to the side on which the latch head (2) presents an inclined plane. This difference in section of the holes on both faces is evident on the drawings, where they are always seen from the face of greater section.

When we mount the affixable piece (16) corresponding to the lesser driving pin depth (12), the first bushed hole (22) will be accommodated in the first real hole (9) of the casing (5); the second bushed hole (23) will cross the window (8) and will be situated between the back pair (7) of prominences and the third bushed hole (24) will be accommodated in the third real hole (11) of the casing. In this case, the means of fastening of the drive member will cross the first (22) and third (24) of the bushed holes.

Figure 15:
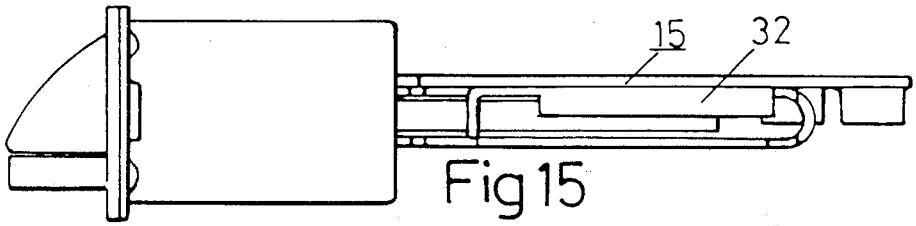
FIGS. 14 and 15 are respectively a view in elevation and vertical plan view from the bottom of the bolt with the affixable piece of FIG. 9 already inserted.

When we mount the affixable piece (15) corresponding to the greater pin depth (13), the first bushed hole (28) will be accommodated in the first real hole (9) of the casing (5); the second bushed hole (19) will be accommodated in the second real hole (10); the third bushed hole (20) will be accommodated in the third real hole (11) of the casing (5) and the fourth bushed hole (21) will be projecting behind the casing (5), as seen on FIG. 15. In this case, the means of fastening of the drive member will cross the second (19) and fourth (21) of the bushed holes.

It is fundamental for correct operation of the latch to obtain proper guiding of the moving member, which is the sliding tail (3), permitted by the large cavities that have been made in this piece, as can be seen in detail on FIGS. 19, 20, 21 and 22. For that purpose, the sliding tail (3), over two-thirds of its length, has its edges bent, each giving rise to transverse flanges (41) and the amplitude of these flanges (41) being equal to the separation of the two faces of the guide casing (5); as the guide casing (5) in turn also has flanges (32) embracing the sliding tail (3) on one of its faces, the correct alignment and guiding of the sliding tail (3) is complete assured on vertical as well as lateral disalignments.

The operating force of the bolt will always be received through one of the two pairs of facing prominences (6 or 7), and in order to increase their strength, these prominences are shaped together with the transverse flanges (41) of the tail. Thus, we see on FIG. 21 that the front pair (6) is strengthened by extending the flanges (41) with a new fold (42). On FIG. 22 in turn and for the back pair of prominences (7), a transverse fold of the surface of the tail (3) that is borne on the flanges (41) is employed; with any of these solutions, we have managed to get the prominences (6 or 7) to the offer a greater bearing surface opposite the drive member used than that of the single thickness of sheet metal of which the sliding tail is made.

The nature of this invention as well as its industrial application having been sufficiently described, it only remains to be added that it is possible to introduce changes of shape, material and arrangement of the assembly and its components, without departing from the scope of the invention, as long as such changes do not detract from its reliability.

I claim:

1. An improved latch bolt with selectively variable driving pin depth of type having a housing; a bolt retractably movable in said housing by means of a transverse drive member, and a guide casing connected to said housing, said guide casing having a window therethrough and three holes therethrough, said three holes having centers aligned with each other wherein the improvement comprises: a single sliding tail connected to said bolt for effecting retractable movement of said bolt, said single sliding tail having two pairs of prominences permanently fixed to said single sliding tail, each prominence of each pair of prominences facing each other and each pair of prominences situated at a different distance from the front of the bolt, said single sliding tail slidably housed in said guide casing such that said two pairs of prominences are situated in said window such that the transverse drive member engages one of the pairs of prominences to effect retraction of the bolt at variable driving pin depths.

2. The improved latch bolt of claim 1 further comprising a flat affixable piece fixed to said guide casing, said flat affixable piece having at least three holes that coincide with said holes in said guide casing, said flat affixable piece having a circular cavity that coincides with said window in said guide casing and an angular amplitude that coincides with the operating path of the transverse drive member thereby acting as a stop that limits the operating path of the transverse drive member.

3. Improved latch bolt with selectively variable driving pin depth, in accordance with claim 2, characterized in that the flat affixable piece has at least three bushings affixed to one side of said flat affixable piece, said bushings aligned with the holes in said flat affixable piece such that said bushings fit inside the holes in said guide casing.

4. Improved latch bolt with selectively variable driving pin depth, in accordance with claim 2, characterized in that the flat affixable piece corresponding to a lesser pin depth possesses a first bushed hole that aligns with the first real hole of the guide casing, a second bushed hole that aligns with the window and is situated between the back pair of prominences and a third bushed hole that aligns with in the third real hole of the casing.

5. Improved latch bolt with selectively variable driving pin depth, in accordance with claim 2, characterized in that the flat affixable piece corresponds to a greater pin depth and possesses a first bushed hole that aligns with the first real hole of the guide casing, a second bushed hole that aligns with the second real hole of the guide casing, a third bushed hole that aligns with the third hole of the guide casing and a fourth bushed hole that is projecting behind the guide casing.

6. Improved latch bolt with selectively variable driving pin depth, in accordance with claim 1, characterized in that the holes existing in the guide casing are in order with respect to the front of the bolt: a first complete circular real hole, a second real hole of proper circular section exceeding one hundred eighty degrees and the rest intersecting with the window, and a third real hole of proper circular section exceeding one hundred eighty degrees and the rest open toward the back edge of the guide casing.

7. Improved latch bolt with selectively variable driving pin depth, in accordance with claim 1, characterized in that over two-thirds of the length of the single sliding tail has its edges folded, such folded edges giving rise to transverse flanges the amplitude of these flanges being equal to the separation of the two faces of the guide casing; and said guide casing having flanges on one of its faces which embrace the flanges of the single sliding tail, thereby correctly guiding and aligning the single sliding tail during movement.

8. Improved latch bolt with selectively variable driving pin depth, in accordance with claim 7, characterized in that the two pairs of facing prominences of the sliding tail are shaped together with the transverse flanges of the tail, thereby enabling the prominences to offer a greater bearing surface opposite the drive member than that of a single thickness of sheet metal of which the sliding tail is made.

* * * * *

UNITED STATES PATENT AND TRADEMARK OFFICE

CERTIFICATE OF CORRECTION

PATENT NO. : 4,850,626

DATED : July 25, 1989

INVENTOR(S) : Luis Valdajos Gellego

It is certified that error appears in the above-identified patent and that said Letters Patent is hereby corrected as shown below:

Column 1, line 28, change "measurements" to --measurement--; lines 34 and 35, change "coexistense" to --coexistence--.

Column 2, line 16, change "choise" to --choice--.

Claim 8, line 3, before "sliding" insert --single--; line 5, before "tail" insert --single sliding--; line 8, before "sliding" insert --single--.

Signed and Sealed this

Twenty-sixth Day of June, 1990

*Attest:*

HARRY F. MANBECK, JR.

*Attesting Officer*

*Commissioner of Patents and Trademarks*